United States Patent [19]

Chaney et al.

[11] 4,011,599

[45] Mar. 15, 1977

[54] ARTICLE OF APPAREL COLLAR AND LAPEL CONSTRUCTION

[75] Inventors: Roy L. Chaney; Sandor G. Rada, both of Cape Girardeau, Mo.

[73] Assignee: Ralph Edwards Sportswear, Inc., Cape Girardeau, Mo.

[22] Filed: Aug. 21, 1975

[21] Appl. No.: 606,586

[52] U.S. Cl. ..... 2/116; 2/143

[51] Int. Cl.[2] ..... A41B 1/00; A41B 3/00

[58] Field of Search ..... 2/98, 116, 129, 122, 2/139, 142, 143, 243 R, 243 B, 255

[56] References Cited

UNITED STATES PATENTS

| | | | |
|---|---|---|---|
| 2,937,376 | 5/1960 | Golden | 2/143 |
| 3,090,962 | 5/1963 | Lockwood | 2/143 |

*Primary Examiner*—Werner H. Schroeder
*Assistant Examiner*—Doris L. Troutman
*Attorney, Agent, or Firm*—Cushman, Darby & Cushman

[57] ABSTRACT

An article of apparel having an improved collar and/or lapel structure, as well as the method of making same, and the patterns for making same. A collar made from a unitary pattern piece is provided for a garment, the collar being double-layered and having a seam extending from each tip thereof to a base thereof between edges forming each tip. Such a seam acts as a stay, and prevents the tip from curling, and also provides a desirable look. Right and left lapels are each constructed from unitary pattern pieces separate from the collar and garment body portion, and each lapel tip includes a seam formed on the underside of a double-layer portion of the lapel, extending from the tip toward a terminal edge of the lapel underside, disposed between the edges forming the tip. The terminal edge of each lapel underside is attached to a terminal edge of the body portion, or a yoke portion thereof. Join seams may be employed.

23 Claims, 10 Drawing Figures

ARTICLE OF APPAREL COLLAR AND LAPEL CONSTRUCTION

BACKGROUND AND SUMMARY OF THE INVENTION

An article of apparel having an improved collar and/or lapel structure is provided, as well as the method and patterns for making same. In making prior art garments a great deal of time has often been spent in raising all the seams around collar and lapel structures, and it has been necessary to employ plastic stays or the like to prevent collar and lapel tips from curling — or if such stays are not practically utilizable in certain garments the lapel and collar tips have been subject to curling over extended usage. This is especially true of leather and suede leather coats and the like. Typical prior art structures are disclosed in U.S. Pat. Nos. 539,834, 1,177,688, 3,488,775, and 3,871,028, and in prior manufactured garments as will be described more fully hereinafter.

According to the present invention, an article of apparel is provided that is generally less expensive to manufacture than comparable prior art garments, requiring less time and labor to be spent in construction thereof, and eliminating the need for any accessory stays. According to the present invention, collar and lapel tips are prevented from curling and remain flat against the garment body portion by seams formed in the underside thereof, which seams do not show on the garment surface during normal usage thereof, however, effectively act to prevent curling. Such seams preferably are join seams, requiring a minimum amount of time and effort as compared to raised seams. Also, a lapel according to the present invention, being formed of a separate piece from the collar and body portion, may be join seamed to the body portion, providing a crease line for the lapel so that it lies flatter against the body portion of the garment.

According to a method of the present invention, a collar is formed from a pattern having a pair of angled side surfaces coming together at a point, the collar pattern is folded to form a double layer collar having a pair of tips each defined by a pair of edges, a base, an underside, and a top surface, and by forming a seam extending from each tip toward the base intermediate the edges defining the tip. The collar may then be attached to the body portion and lapel, with or without stands. Each lapel is formed from a pattern formed of a single sheet and having four adjacent angled side edges coming together in points, by folding the lapel pattern to form a double-layerd generally triangular portion having a top surface, underside, and a tip defined by two edges, and a single-layer terminal edge on the underside, and by forming a seam extending from the tip to the terminal edge intermediate the tip forming edges. The lapel is then attached to the article body portion with a join seam along the terminal edge and a terminal edge of the article body portion. A pair of yokes may be provided as the body portion sections having terminal edges thereon for connection to each lapel, and the collar, yoke, and lapel can be connected together, and the assembly thereof then connected to the rest of the garment.

Accordingly, it is the primary object of the present invention to provide an article of apparel having an improved collar and/or lapel construction, and improved methods and patterns for making of the apparel article. This and other objects of the invention will become clear from an inspection of the detailed description of the invention and from the appended claims.

DETAILED DESCRIPTION OF THE INVENTION

Figure 1B:
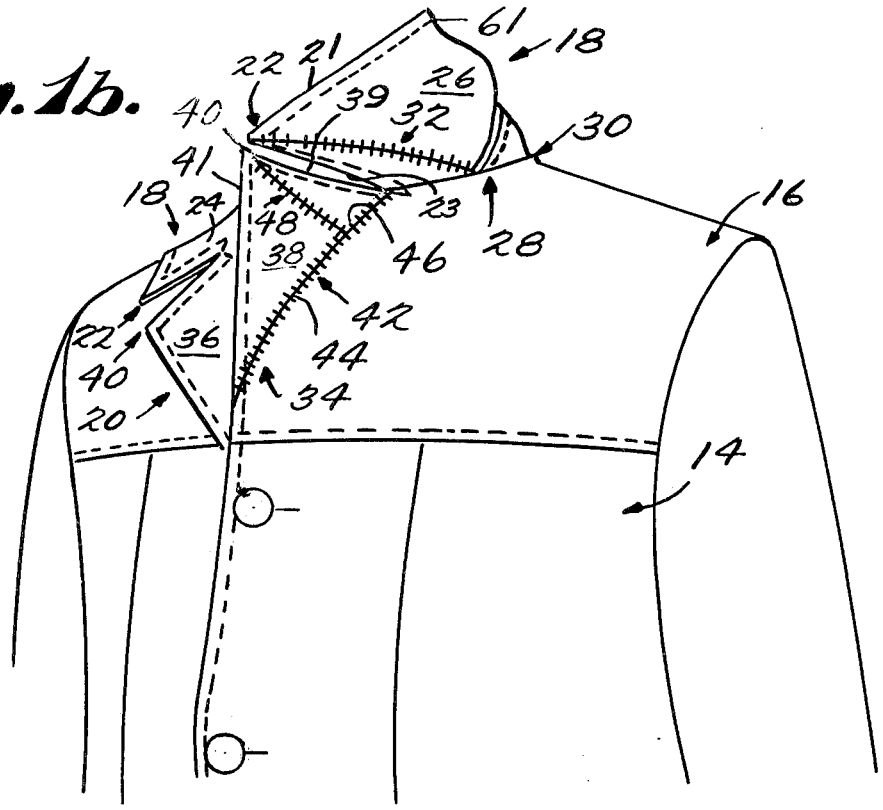
FIG. 1*b* is a perspective view of an exemplary article of apparel according to the present invention.
Figure 1A:
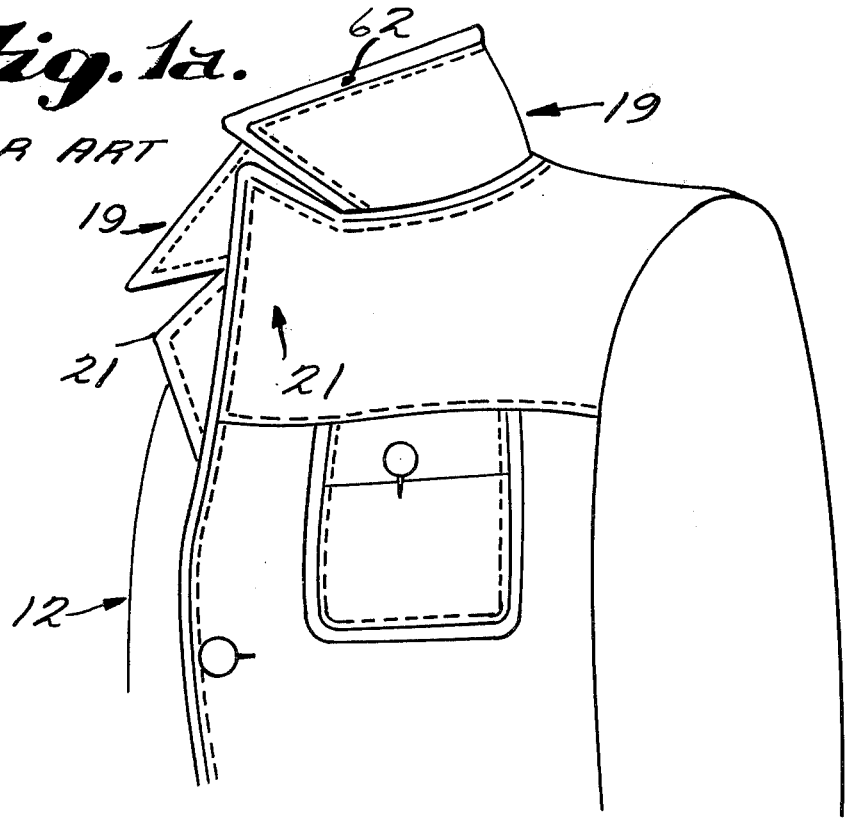
Fig. 1a. PRIOR ART
FIG. 1*a* is a perspective view of a prior art article of apparel having a conventional collar and lapel.

An article of apparel according to the teachings of the present invention is shown in perspective generally at 10 in FIG. 1*b*. The actual article pictured in FIG. 1*b* is a suede coat, however, the teachings of the present invention are applicable to a wide variety of other articles of apparel, such as all types of men's and women's coats, shirts, blouses, sport jackets, men's and women's suits, etc., made from any fabric or material. An article of apparel 10 according to the present invention has a number of advantages over a comparable prior art article of apparel, such as prior art suede coat 12 shown in FIG. 1*a*. In addition to style and aesthetic advantages, an article 10 according to the present invention has a collar and lapel that are easier to make, are less expensive to manufacture, require less labor for the manufacture thereof, and have tip portions that will stay generally flat against the article body even over extended usage thereof, not having a tendency to "curl" upwardly during cleaning or after extended usage.

The coat 10 shown in FIG. 1*b* includes a body portion 14, including an optional yoke portion 16, a collar 18, and right and left lapels 20. The collar 18 is formed separately from the body portion 14 and the right and left lapels 20, and has a pair of tips 22, in the embodiment illustrated the tips 22 forming the most downwardly extending portion of the collar 18. The collar 18 is generally a double-layered member and has a "top" surface 24 that is disposed on the outside of the garment 10 during normal usage of the article 10, and an "underside" 26 that is normally disposed beneath the top surface 24, and generally out of view except when the collar 18 is turned upwardly, as in the right-hand portion of FIG. 1*b*. The collar 18 is attached at a base portion 28 thereof to the body portion 14 and the lapels 20 by stitching 30 of any suitable type.

As an important feature of the collar 18 according to the present invention, a seam 32 is provided extending from each tip 22 toward the base portion 28 intermediate the edges 21, 23 forming the tip 22. This seam 32 joins together two terminal edge portions of a collar pattern in a manner to be hereafter more fully described. In addition to providing an easier manner of construction of a collar, as will be more fully described hereinafter, the seam 32 functions to hold the collar tip 22 down even through extended usage thereof. In this way, it acts as a built in "stay". Such a seam 32 can be extremely useful in shirt collars especially, eliminating the need for conventional plastic stays formed in the conventional shirt collars, and thereby reducing the manufacturing time and difficulty, and the material costs and in all other collars, minimizing the tendency of tips 22 to curl. Since the seam 32 merely connects two terminal edges together, it is easy to effect, not requiring the time or effort necessary for the creation of other conventional types of seams such as raised seams. The seam 32 is referred to as a "join seam", meaning a simple stitching together of two edge members or two pieces of fabric adjacent an edge. This is opposed to a "raised seam" wherein a first stitch is made, and then a portion of material is folded over and another stitch made, raised seams generally requiring more effort and time than join seams.

It is apparent that the collar construction 18 can be used for virtually any article of apparel that has a collar, whether or not a lapel is provided too. Similarly, the lapels 20 according to the present invention could also be used separately from the collar 18 according to the present invention, as desired.

Each lapel 20 according to the present invention includes a folded over portion 34 thereof (which portion 34 is exterior of the body portion 14) including a top surface 36, and underside 38, and a tip 40. The lapels 20 are formed from single sheets of material separate from the body portion 14 and the collar 18. A seam 42 joins the terminal edge 44 of the underside 38 of lapel 20 to a terminal edge 46 of body portion 14, and a seam 48 extends from the tip 40 to the seam 42 of each lapel 20 between the edges 39, 41 forming the tip 40. Again, preferably the seams 42 and 48 are join seams, which is possible since merely terminal edges of fabric sheets are being joined. Again the seam 48 acts like a stay, preventing the tip 40 from curling upwardly and away from the body portion 14 even after extended usage, and the seam 42 provides a clear crease line allowing the top surface 36 of each lapel 20 to bend thereat, and causing the lapel to lie flatter against the body portion 14. The distinctions between the construction according to the present invention and an exemplary prior art construction are made clear by an inspection of the collar and lapel portions 19 and 21 respectively of prior art garment 12 in FIG. 1*a*.

Figure 2:
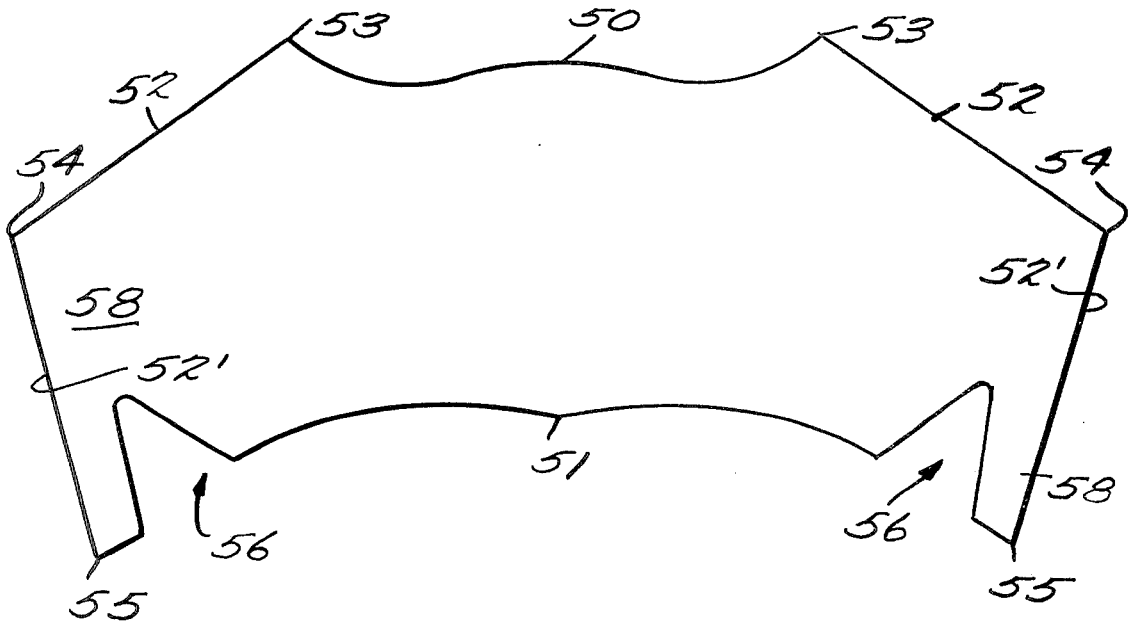
FIG. 2 is a top plan view of an exemplary collar pattern according to the present invention.

The method of manufacture of a garment according to the present invention will now be described, reference being had to FIGS. 2–5 especially for the collar construction, and FIGS. 6–8 especially for the lapel construction. FIG. 2 shows a collar pattern C according to the present invention that is the starting point for construction of a collar 18 according to the present invention. The collar pattern C preferably is a single piece of fabric, as opposed to the prior art wherein two separate pattern pieces are stitched together — conventionally with raised seams — to form a separate collar piece. The pattern C generally comprises a top edge 50, a bottom edge 51, and two pairs of balanced side edges, 52, 52′. The side edges 52, 52′ are each at an angle with respect to both the top and bottom edges 50, 51 and come together in a point 54 — each side edge 52 comes together with top edge 50 at a point 53. A generally V-shaped slit or the like 56 is formed in the bottom edge 51 adjacent edges 52′, each slit 56 extending toward the center of pattern C. Each side edge 52′ comes together with bottom edge 51 at a point 55 spaced from slit 56.

It is noted that while the terms "top", "bottom", and "side" have been used for reference purposes, they are merely reference terms, and it is not required that the edge 50 always be "on top", etc. The pattern C may be formed according to any suitable method with any suitable apparatus.

Figure 3:
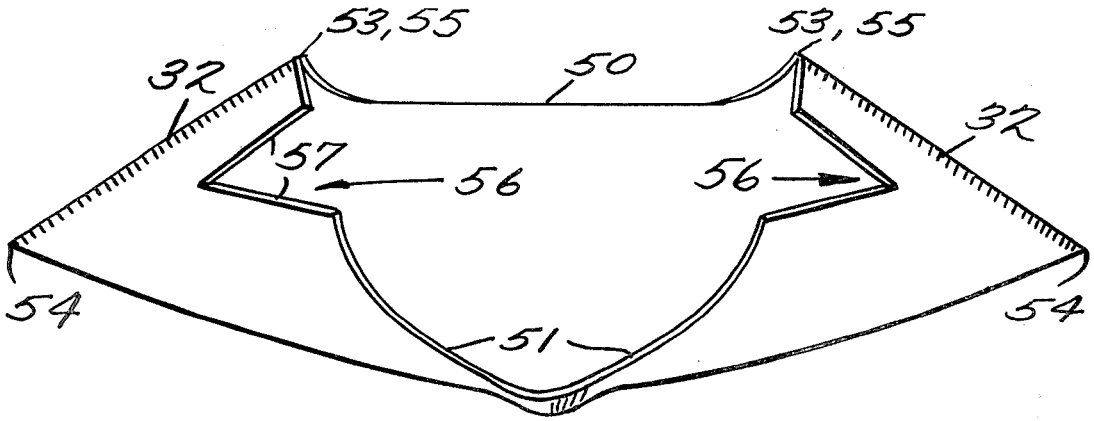
FIG. 3 is a top view of the pattern of FIG. 2 after several method steps according to the present invention have been performed thereon.

Once the collar pattern C is formed, points 55 are brought into juxtaposition with points 53, and side edges 52, 52′ are joined together with a join seam 32 (FIG. 3). The joining is a simple operation, and may be performed on any suitable machine. Once the edges 52, 52′ are joined, the collar is folded to make it smooth — so that it assumes the position of FIG. 4, edges 21, 23 forming the tips 22. In this position edges 50, 51 generally match up, and form collar base 28, the edges 57 of each slit 56 match up, and points 54 serve as collar tips 22. Each seam 32 extends from the tip 22 to the base 28. The collar is now ready for attachment to an article of apparel if desired, after it is "turned" (inverted so that the right side is out — the surface with the best finish) using any suitable turning means such as a conventional collar turner. It will be seen that a generally double layer collar 18 has been provided having a top surface 24, and an underside 26, the collar being formed of one piece, and having built-in stays (in seams 32) for tips 22. If the collar is to be connected directly to a garment body portion, normally the edges 50, 51 would be shaped slightly differently to conform to a garment neck portion.

Figure 4:
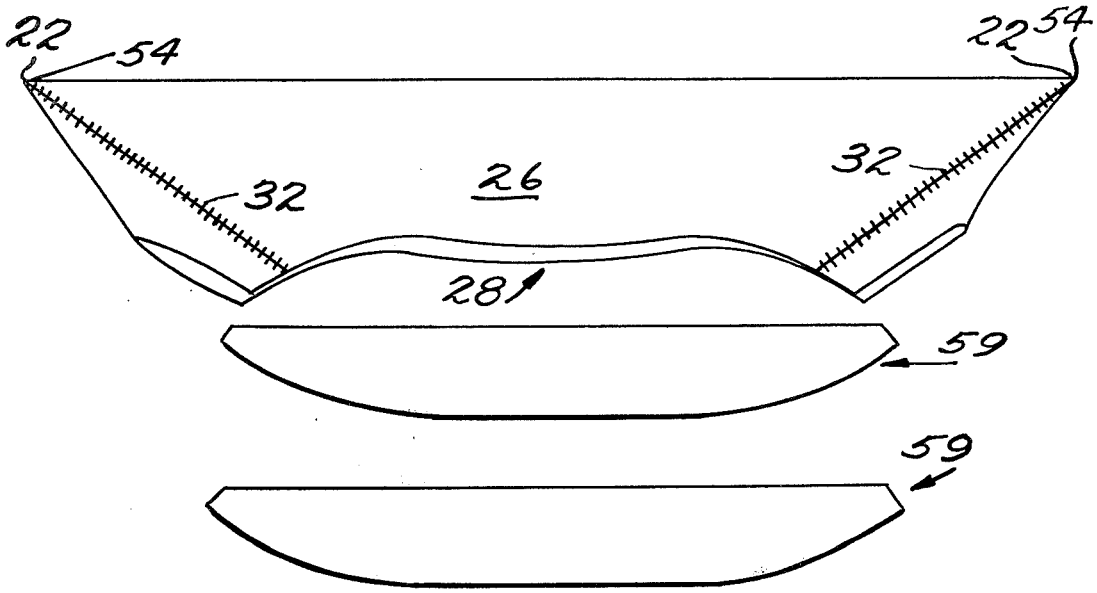
FIG. 4 is a top view of the collar of FIG. 3 with optional stands therefor after the collar has been turned.
Figure 5:
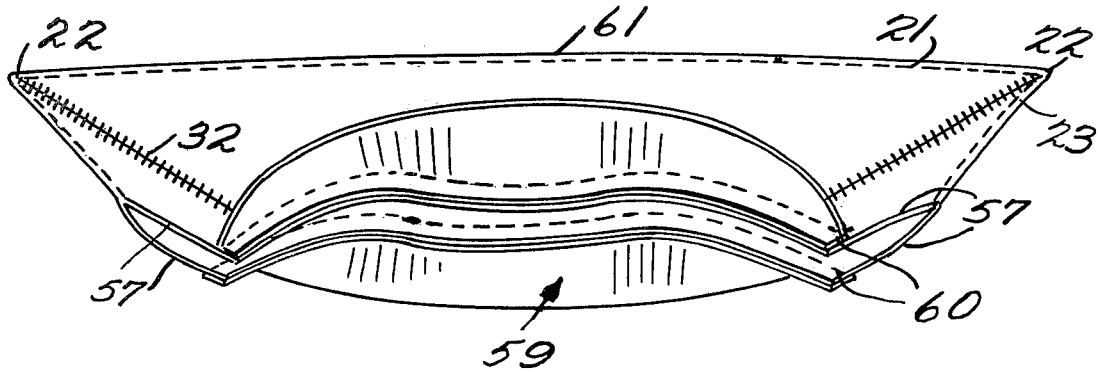
FIG. 5 is a top view of the collar of FIG. 4 with stands attached thereto.

If desired, the collar 18 may be attached to the garment body portion 14 with stands 59, such as when a suede coat as shown in FIG. 1*b* is to be formed. The optional stands 59, as seen in FIGS. 4 and 5, are affixed to the base portion 28 (edges 50 and 51 respectively) of the collar 18 with seams 60, which seams 60 preferably are raised seams. The stands 59 may then be stitched to the neck area of the main body portion 14, as shown in FIG. 1*b*, as may the edges 57 along the slits 56. While decorative stitching 61 may be provided around the top and sides of the collar 18, such stitching is optional and is relatively easy to effect — this is compared to the conventional prior art collar 19 and stitching 62 shown in FIG. 1*a*, which stitching 62 is required to hold separate collar pieces together, and which stitching 62 conventionally is raised stitching. The collar 18 according to the present invention being formed from a single pattern, such stitching is avoided.

Figure 6:
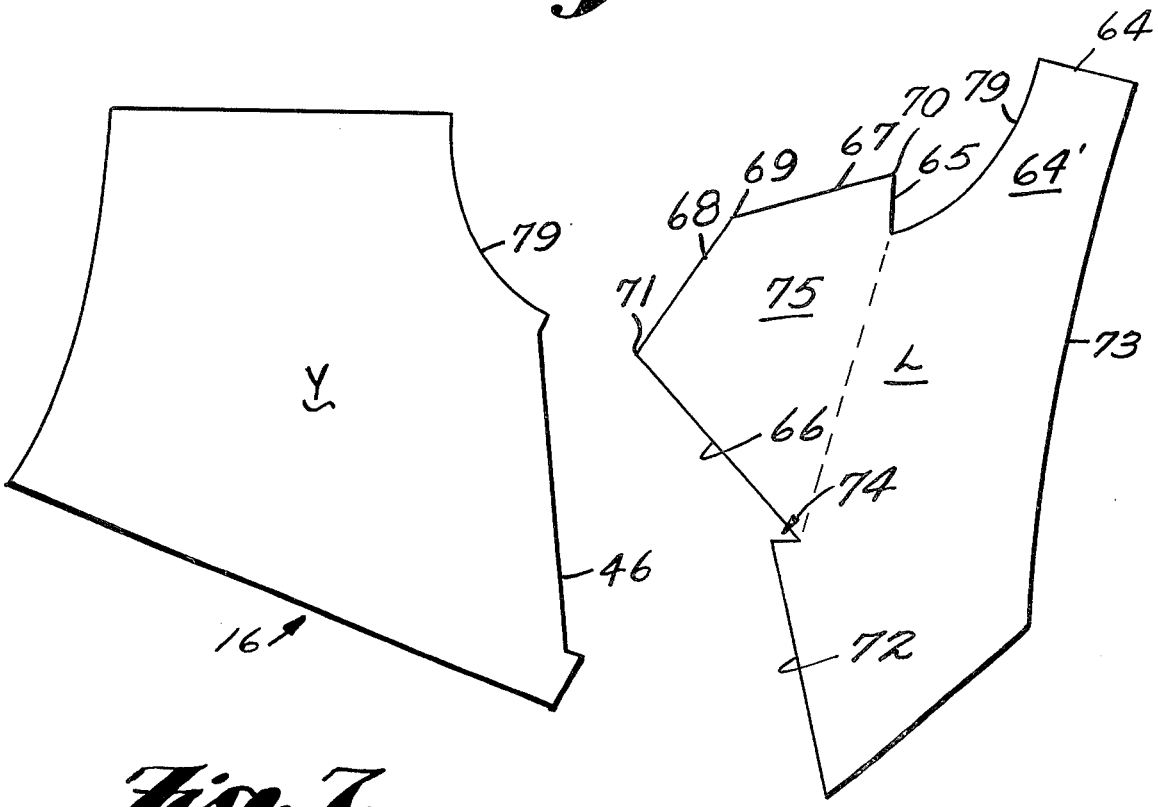
FIG. 6 is a top plan view of a lapel pattern according to the present invention, and an optional yoke pattern.
Figure 7:
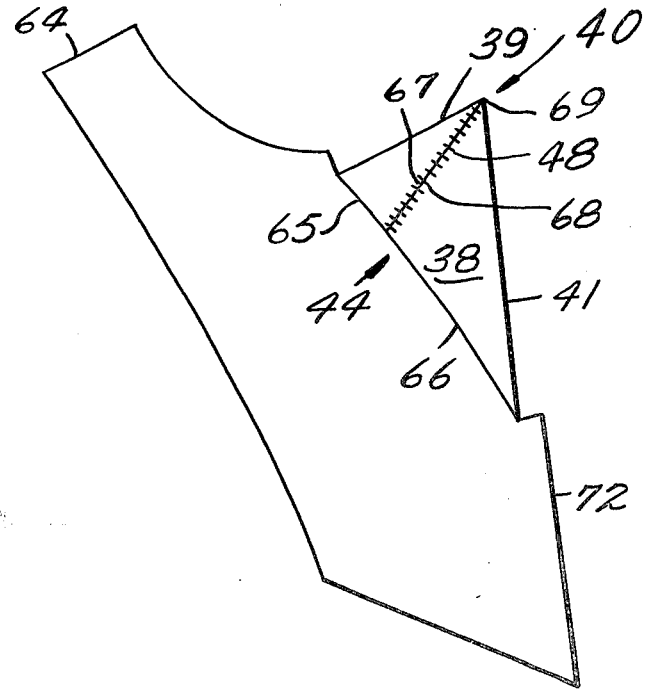
FIG. 7 is a top view of the lapel pattern of FIG. 6 after several method steps according to the present invention have been performed thereon.
Figure 8:
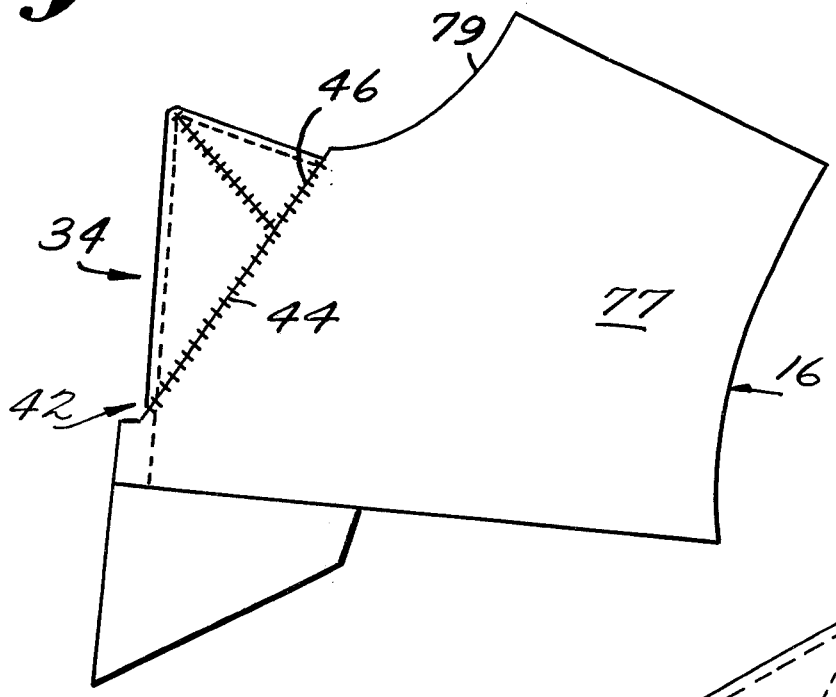
FIG. 8 is a top view showing the lapel of FIG. 7 joined to the yoke of FIG. 6.

If it is desired to construct a pair of lapels 20 according to the present invention method steps generally similar to those with respect to formation of collar 18 are undertaken, reference being had to FIGS. 6–8 especially. Each lapel 20 is formed from a unitary sheet pattern L separate from the collar 18 (as contrasted with the prior art arrangement shown in FIG. 1*a*) and the body portion 14. Each pattern L, as shown generally in FIG. 6, comprises a top edge 64 formed on a strip 64′ extending generally upwardly from the rest of the pattern L, a bottom edge 72 and four angled side edges 65, 66, 67, 68 each edge 65, 66, 67, 68 making an angle with respect to the bottom edge 72 and the top edge 64, and coming together in points 69, 70 and 71. The edge 66 comes into contact with the bottom edge 72 adjacent a slit 74 or the like. Another side edge 73 also is provided. The side edge 73 and the top and bottom edges 64, 72 may be shaped as desired to fit the particular circumstances, varying with the garment to be made since they will generally be disposed in the interior of the garment to be formed. Only the arrangement of the extending portion 75 (see dotted line in FIG. 6) — which forms the double layer 34 — of pattern L, the portion having edges 65, 66, 67, and 68, is necessarily formed of a particular shape, it being necessary that a set of points generally like 70, 71 be provided, with a point generally like 69 therebetween.

Again, the terms "top", "side", etc., are used for reference purposes only, and are not restrictive of the particular orientation of the pattern L or the lapel 20 formed thereby. Pattern L also may be formed in any suitable manner with any suitable apparatus.

Once the pattern L is formed, the lapel 20 is constructed merely by bringing point 70 into juxtaposition with point 71, and joining edges 67, 68 together with a join seam 48. Reference may be had to FIG. 7 wherein join seam 48 has been effected and the lapel turned (inverted right side out). Turning actually need not be performed until a later step in formation of the apparel article 10, but FIG. 7 is provided for reference with respect thereto. It is noted that after seam 48 is formed, point 69 becomes lapel tip 40, formed by edges 39, 41 and edges 65, 66 become the terminal edge 44 of lapel 20. A lapel is formed hereby that has a built-in stay in seam 48 and which is formed of an integral piece separate from the collar 18 and body portion 14.

Once the seam 48 is formed in each lapel 20, terminal edge 44 of each lapel 20 is secured to a terminal edge 46 of body portion 14. When a yoke 16 is employed, as shown in FIGS. 1*b*, 6, and 8, which yoke is formed from a pattern Y or the like, the terminal edge 46 is a portion of the yoke 16 rather than the rest of the body portion 14. Since one single layer edge is secured to another (44, 46), a join seam may be employed for seam 42. The join seam 42 provides a crease line about which the top surface 36 of the lapel 20 can bend. The seam 42 (as with seam 48) assists in disposing the underside 38 of lapel 20 against the outer surface of yoke 16, or a similar body portion. When the assembly of lapel 20 and yoke 16 is made, it can be seen (see FIGS. 1*b* and 8 especially) that only the double-layered portion 34 of the lapel 20 is disposed on the outside of the article of apparel 10 (that is normally visible), the rest of the pattern L being disposed inside the article 10, being covered by the yoke 16 and other sections of body portion 14. Decorative stitching 80 may also be provided on the double layer portion 34 of lapel 20, however, again the same is not necessary since the double layer portion was formed from a single piece pattern.

Figure 9:
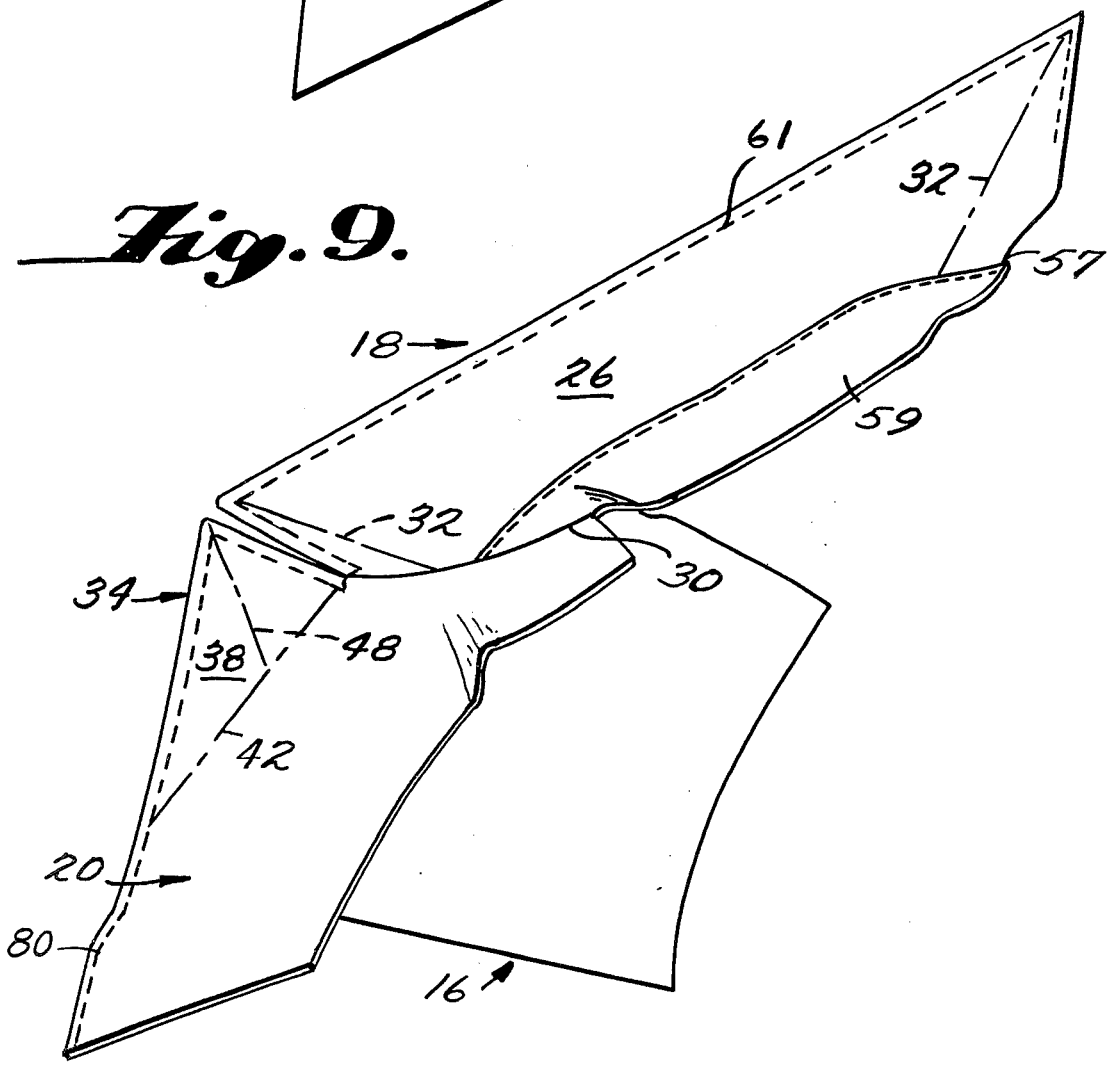
FIG. 9 is a top view of the collar with stands of FIG. 5 attached to the assembly of FIG. 8 prior to attachment of the combination thereof to the rest of the article of apparel body portion.

Once the lapels 20 and collar 18 have been formed, and once the lapels 20 are attached to the yokes 16 if yokes are to be utilized, the collar 18 and the assemblies 16–20 are joined together, as shown in FIG. 9. FIG. 9 shows one lapel 20 — the right lapel — being attached to the collar 18 having stands 59. The seams 32, 42, and 48 are shown in dotted line in FIG. 9 since they are on the underside of the portions 18, 20 as viewed in FIG. 9. Common line 79 of yoke 16 and lapel 20 is secured to collar base portion 28, edges 57, and to the bottom of stands 59 by any suitable stitching 30. The left hand lapel 20 is connected to collar 18 in a manner corresponding to that shown in FIG. 9, and then the whole assembly 18, 20, 16 is connected to the rest of the article of apparel 10 body portion 14, by any suitable method with any suitable apparatus to form the final article shown in FIG. 1*b*.

It will thus be seen that according to the present invention, an article of apparel and a method and patterns for making such article of apparel have been provided that fulfill the objects of the present invention, providing an article of apparel wherein the collar and/or lapel stay flatter against the article body portion even during extended usage thereof, and providing a collar and/or lapel that is easier to construct and less expensive to construct.

While the invention has been herein shown and described in what is presently conceived to be the most practical and preferred embodiment, it will be apparent to one of ordinary skill in the art that many modifications thereof can be made within the scope of the invention, which scope is to be accorded the broadest interpretation of the appended claims so as to encompass all equivalent structures and methods.

What is claimed is:

1. An article of apparel including a. a body portion, b. a collar formed separately from said body portion, said collar comprising two layers of material, a bottom layer and a top layer, said bottom layer comprising an underside, and said collar further comprising a pair of tips each formed by converging edges of said underside, and a base, and a seam extending from each tip toward said base on the underside of said collar between said tip forming edges and joining said edges, and c. means for attaching said collar to said body portion at the base of said collar.

2. An article of apparel as recited in claim 1 wherein the seam extending from each collar tip toward the base between the tip forming edges is a join seam.

3. An article of apparel as recited in claim 2 wherein said means for attaching said collar to said body portion at the base of said collar includes a pair of stands.

4. An article of apparel as recited in claim 1 further comprising d. right and left lapel members formed separately from said body portion and said collar, each said lapel member including a double layer generally triangularly shaped portion having a top surface, an underside, an underside terminal edge, and a tip formed by edges, e. means for attaching each said lapel member to said body portion, said means including a seam formed between each lapel member underside terminal edge and a corresponding terminal edge on said body portion, and f. a seam extending along the underside of each lapel member from each tip to the underside terminal edge between the tip forming edges.

5. An article of apparel as recited in claim 4 wherein each said seam extending from a lapel member tip to its terminal edge is a join seam, and wherein each said seam connecting each terminal edge of said body portion to a corresponding lapel member underside terminal edge is a join seam.

6. An article of apparel as recited in claim 4 wherein said body portion includes a right and a left yoke formed separately from the rest of the body portion, said right yoke being connected to said right lapel member and said collar, and said left yoke being connected to said left lapel member and said collar.

7. An article of apparel including a. a body portion having a front at least partially open and a pair of terminal edges along the open front, b. right and left lapel members formed separately from said body portion, each member including a double layer generally triangularly shaped portion having a top surface, an underside, an underside terminal edge, and a tip formed by converging edges, c. means for attaching each said lapel member to said body portion, said means including a seam formed between each lapel member underside terminal edge and a said terminal edge of said body portion, and d. a seam extending along the underside of each lapel member from each tip to the underside terminal edge between said tip forming edges.

8. An article of apparel as recited in claim 7 wherein each said seam extending from a lapel member tip to its terminal edge is a join seam, and wherein each said seam connecting each terminal edge of said body portion to a corresponding lapel member underside terminal edge is a join seam.

9. An article of apparel as recited in claim 7 wherein said body portion includes a right and a left yoke formed separately from the rest of the body portion, said yokes having said body terminal edges and said right yoke being connected to said right lapel member and said left yoke being connected to said left lapel member.

10. A method of forming an article of apparel having a body portion and a collar, said method comprising the steps of a. forming a body portion of said article, b. forming a collar pattern of a single unitary sheet of material separate from said body portion, c. folding said collar pattern to form a double layer collar having a pair of tips each formed by converging edges, a base, an underside, and a top surface, d. forming a seam extending from each tip toward said base on the underside of said collar between said tip forming edges, and e. attaching said collar to said body portion along said collar base.

11. A method as recited in claim 10 wherein said step of forming a seam extending from each tip toward said base on the underside of said collar is accomplished by forming a join seam between two edge portions of said collar pattern.

12. A method as recited in claim 11 wherein said step of attaching said collar to said body portion is accomplished by attaching a collar stand to each of said collar layers at said collar base, and attaching said stands to said body portion.

13. A method as recited in claim 11 wherein said step of forming a collar pattern is accomplished by forming a single sheet of material having the following configuration:

a top edge, a bottom edge, two pairs of side edges, each side edge being angled with respect to said top and bottom edges, and each pair of side edges converging together in a protruding point, and a slit extending from said bottom edge, adjacent each pair of said edges, toward the pattern interior.

14. A method as recited in claim 10 comprising the further steps of f. forming right and left lapel patterns each from a unitary fabric sheet separate from said body portion and said collar, g. folding each of said lapel patterns to form a double-layered generally triangularly shaped portion having a tip formed by converging edges, an underside, a top surface, and an underside terminal edge, h. forming an underside seam extending from each lapel to tip to said terminal edge between said tip forming edges, and i. attaching each of said lapel double-layered portions to said body portion along said underside terminal edge to a terminal edge of said body portion, by forming a seam therealong.

15. A method as recited in claim 14 wherein said step of attaching each of said lapels to said body portion is accomplished by forming a join seam between each said lapel underside terminal edge and a terminal edge of said body portion.

16. A method as recited in claim 14 wherein said step of forming a seam extending from each lapel tip to said underside terminal edge is accomplished by forming a join seam.

17. A method as recited in claim 14 wherein said body portion includes a right and a left yoke each formed separately from the rest of the body portion and attached thereto, said right yoke being connected to said right lapel and said collar, and said left yoke being connected to said left lapel and said collar, said terminal edges of said body portion being formed on said yokes.

18. A method as recited in claim 14 wherein said step of forming right and left lapel patterns is accomplished by forming two unitary sheets of material each having the following configuration:

four side edges each making an angle with respect to the others and adjacent ones converging in protruding points, a bottom edge, a slit formed between the bottom edge and an adjacent side edge, a top edge, and a side edge opposite said top and bottom edges of said four side edges.

19. A method of forming an article of apparel having a body portion and a lapel, said method comprising the steps of a. forming a body portion having at least a partially open front and a pair of terminal edges along said open front, b. forming right and left separate lapel patterns separate from said body portion, c. folding each of said lapel patterns to form a double-layered generally triangularly shaped portion having a tip formed by converging edges, an underside, a top surface, and an underside terminal edge, d. forming a seam extending from each lapel tip to said associated terminal edge between said tip forming edges, on the underside of said layered portion, and e. attaching each of said lapel terminal edges to said body portion along said body portion terminal edges by forming a seam therealong.

20. A method as recited in claim 19 wherein said step of attaching each of said lapels to said body portion is accomplished by forming a join seam between each said lapel underside terminal edge and a terminal edge of said body portion.

21. A method as recited in claim 19 wherein said step of forming a seam extending from each lapel tip to said underside terminal edge is accomplished by forming a join seam.

22. A method as recited in claim 19 wherein said body portion includes a right and a left yoke each formed separately from the rest of the body portion and attached thereto, said right yoke being connected to said right lapel and said collar, and said left yoke being connected to said left lapel and said collar, said terminal edges of said body portion being formed on said yokes.

23. A method as recited in claim 19 wherein said step of forming right and left lapel patterns is accomplished by forming two unitary sheets of material each having the following configuration:

four side edges each making an angle with respect to the others and adjacent ones converging in protruding points, a bottom edge, a slit formed between the bottom edge and an adjacent side edge, a top edge, and a side edge opposite said top and bottom edges of said four side edges.

* * * * *